US008544529B2

(12) United States Patent
Noel-Baron et al.

(10) Patent No.: US 8,544,529 B2
(45) Date of Patent: Oct. 1, 2013

(54) HEAT EXCHANGER WITH PLATES

(75) Inventors: Olivier Noel-Baron, Echirolles (FR); Christophe Wibaut, Gieres (FR)

(73) Assignee: Alfa Laval Viacarb, Fontanil Cornillon (FR)

( * ) Notice: Subject to any disclaimer, the term of this patent is extended or adjusted under 35 U.S.C. 154(b) by 1066 days.

(21) Appl. No.: 12/520,107

(22) PCT Filed: Dec. 20, 2007

(86) PCT No.: PCT/FR2007/052576
§ 371 (c)(1),
(2), (4) Date: Jun. 29, 2009

(87) PCT Pub. No.: WO2008/084174
PCT Pub. Date: Jul. 17, 2008

(65) Prior Publication Data

US 2010/0044021 A1 Feb. 25, 2010

(30) Foreign Application Priority Data

Dec. 21, 2006 (FR) ..... 06 55792

(51) Int. Cl.
*F28F 3/10* (2006.01)

(52) U.S. Cl.
USPC ..... 165/78; 165/166; 165/DIG. 367

(58) Field of Classification Search
USPC ..... 165/78, 167; 277/637
See application file for complete search history.

(56) References Cited

U.S. PATENT DOCUMENTS

| | | | | | |
|---|---|---|---|---|---|
| 2,550,339 | A | * | 4/1951 | Ehrman | 165/167 |
| 3,244,227 | A | * | 4/1966 | Usher | 165/167 |
| 4,377,204 | A | * | 3/1983 | Johansson | 165/166 |
| 4,635,715 | A | * | 1/1987 | Andersson | 165/167 |
| 4,995,455 | A | * | 2/1991 | Mathur | 165/166 |
| 5,070,939 | A | * | 12/1991 | Mathur | 165/166 |
| 5,178,212 | A | * | 1/1993 | Nakamura | 165/166 |
| 5,193,612 | A | | 3/1993 | Stirnkorb | |
| 5,727,620 | A | * | 3/1998 | Schaufele et al. | 165/166 |
| 5,887,650 | A | * | 3/1999 | Yang | 165/166 |

(Continued)

FOREIGN PATENT DOCUMENTS

| | | |
|---|---|---|
| EP | 0487931 A1 | 6/1992 |
| EP | 0864837 A2 | 9/1998 |

(Continued)

OTHER PUBLICATIONS

International Search Report for PCT/FR2007/052576 dated Sep. 2, 2008.

(Continued)

*Primary Examiner* — Allen Flanigan
(74) *Attorney, Agent, or Firm* — Heslin Rothenberg Farley & Mesiti P.C.

(57) ABSTRACT

A heat exchanger comprises a set of plates defining between them circuits for a fluid flowing alternately via seals mounted between each pair of two adjacent plates. Each plate including at least one guiding cut formed at least at one of the ends thereof for guiding each plate inside a frame. The exchanger also includes between each pair of two adjacent plates, and in proximity to the guiding cut, at least one strut to be compressed and in contact with the two adjacent plates. Each strut has, before compression, a thickness at least equal to that of the seal.

10 Claims, 2 Drawing Sheets

(56) References Cited

U.S. PATENT DOCUMENTS

| | | | | |
|---|---|---|---|---|
| 6,073,687 | A * | 6/2000 | Jensen et al. | 165/167 |
| 6,513,584 | B2 * | 2/2003 | Lehmann et al. | 165/166 |
| 6,935,415 | B1 * | 8/2005 | Petersen et al. | 165/166 |

FOREIGN PATENT DOCUMENTS

| | | | |
|---|---|---|---|
| FR | 770517 | A | 9/1934 |
| GB | 615905 | A | 1/1949 |
| GB | 1592069 | A | 7/1981 |
| GB | 2141814 | A | 1/1985 |
| JP | 3 121368 | | 12/1991 |
| JP | 5 346296 | | 12/1993 |
| JP | 3061100 | | 6/1999 |
| RU | 2165570 | C2 | 4/2001 |
| RU | 2225580 | C2 | 3/2004 |
| WO | 2006/080874 | A | 8/2006 |

OTHER PUBLICATIONS

Decision on Grant for corresponding Russian application No. 2009128028.

* cited by examiner

HEAT EXCHANGER WITH PLATES

CROSS REFERENCE TO RELATED APPLICATIONS

This application is a national stage filing under section 371 of International Application No. PCT/FR2007/052576 filed on Dec. 20, 2007, and published in French on Jul. 17, 2008 as WO 2008/084174 and claims priority of French application No. 0655792 filed on Dec. 21, 2006, the entire disclosure of these applications being hereby incorporated herein by reference.

TECHNICAL FIELD

The invention relates to the field of heat exchangers with plates between which two fluids brought to different temperatures flow and one of which receives/drains the heat energy of the other.

The invention is more particularly targeted at exchangers with large-sized plates, the frame of which has on the inside a guide rail for guiding the plates in parallel inside the frame before the plates are tightened to each other to provide the seal between the two circuits.

PRIOR ART

Generally speaking, in order to provide the seal between the different fluid circuits, a peripheral seal is placed on each of the plates of the exchanger. Such plates fitted with peripheral seals are described in particular in the document GB-1 592 069.

However, when the plates are very large in size, a displacement may occur between each of the plates when they are inserted inside the frame and then when the plates are tightened against each other. Said displacement may be caused in particular by using a seal which is pointed in shape and is also known by the term "ROOF TOP". Indeed, when a plate comes into contact with the tip of the seal of the adjacent plate, it is then positioned substantially crosswise and swings around the edge defined by the tip of the seal. This phenomenon is especially marked when the plates have a single guiding cut to facilitate the installation of the plates inside the frame.

The purpose of the invention is therefore to eliminate the displacement which may occur between the different plates of a heat exchanger when the plates are positioned in the frame and then when the plates are tightened against each other. Moreover, this objective is met and without detriment to the sealing function fulfilled by the peripheral seal.

DESCRIPTION OF THE INVENTION

The invention therefore relates to a heat exchanger comprising a set of plates defining between them circuits for a fluid flowing alternately via seals mounted between each pair of two adjacent plates. Each plate includes at least one guiding cut formed at least at one of the ends thereof and which allows each plate to be guided inside a frame.

According to the invention, the heat exchanger is characterized in that it also includes between each pair of two adjacent plates, and in proximity to the guiding cut, at least one strut to be compressed and in contact with the two adjacent plates, each strut having before compression a thickness at least equal to that of the seal.

In other words, when the plates of the exchanger are positioned inside the frame, they are oriented in parallel relative to each other while coming into contact with the strut positioned on the adjacent plate. Furthermore, before the plates are tightened against each other, the seal is not acted upon and consequently it does not come into contact with the adjacent plate.

Thus, when plate tightening commences, the plates are all arranged in parallel relative to each other and no displacement can occur, even when the seal is pressurized since the strut positioned in proximity to the guiding cut prevents any swinging of one plate relative to the other.

To advantage, each strut may be inserted into a groove formed in one of the plates with which it comes into contact.

Indeed, like the seal, the strut may be positioned, or even bonded, inside a groove thereby preventing the strut from sliding in particular during tightening.

These grooves are generally made by means of a press and a stamp during the plate die stamping operation so as to generate a plurality of corrugations thereby increasing the surface of the heat exchange between the fluids inside the exchanger.

In practice, each strut may be substantially in the shape of a rectangular parallelepiped. As such, it comprises two parallel faces, and it is of constant cross-section compatible with a manufacturing process such as extrusion or moulding.

According to one particular embodiment, each strut may offer greater compressibility than the seal.

Therefore, when the plates are tightened against each other, the strut, which has a thickness greater than that of the seal, is capable of being compressed without hindering the subsequent compression of the seal.

Furthermore, such a strut may be made in different ways and be secured or not secured to the seal.

According to a first alternative, each strut may be an excrescence of the seal. The seal and the strut thus form a monolithic unit which can be made in a single operation, in particular via a moulding process.

To advantage, the heat exchanger may comprise a link portion between each seal and each strut. This configuration allows the strut to be placed in proximity to the guiding cut, without however changing the position of the seal on the plate. The only function of this link portion is to make it easier to manufacture the exchanger by avoiding an increase in the number of parts in its constitution and to position the strut on the plate. This link portion has a thickness which is less than that of the seal, and consequently less than that of the strut as well.

According to a second alternative, each strut may be disconnected from the seal. As such, it is possible to arrange each of the elements on a plate independently. Such an alternative therefore means that the link portion can be eliminated and the existing seals used in conventional already manufactured heat exchangers.

Different seal and strut embodiments are conceivable and in particular they may be made out of materials that are or are not different.

Thus, according to a first embodiment, the struts and the seals may be made out of a single material. They may thus for example be moulded in the same mould and manufactured simultaneously.

According to a second embodiment, the struts and seals may be made out of two different materials. As such, it is in particular possible to adapt the compressibility of the struts so as not to change locally the compressibility of the seal.

BRIEF DESCRIPTION OF THE FIGURES

The way the invention is embodied, and the resulting advantages, will become clearer from the following embodiment description, given by way of information but non-restrictively, supported by the figures wherein.

DESCRIPTION OF THE INVENTION

Figure 1:
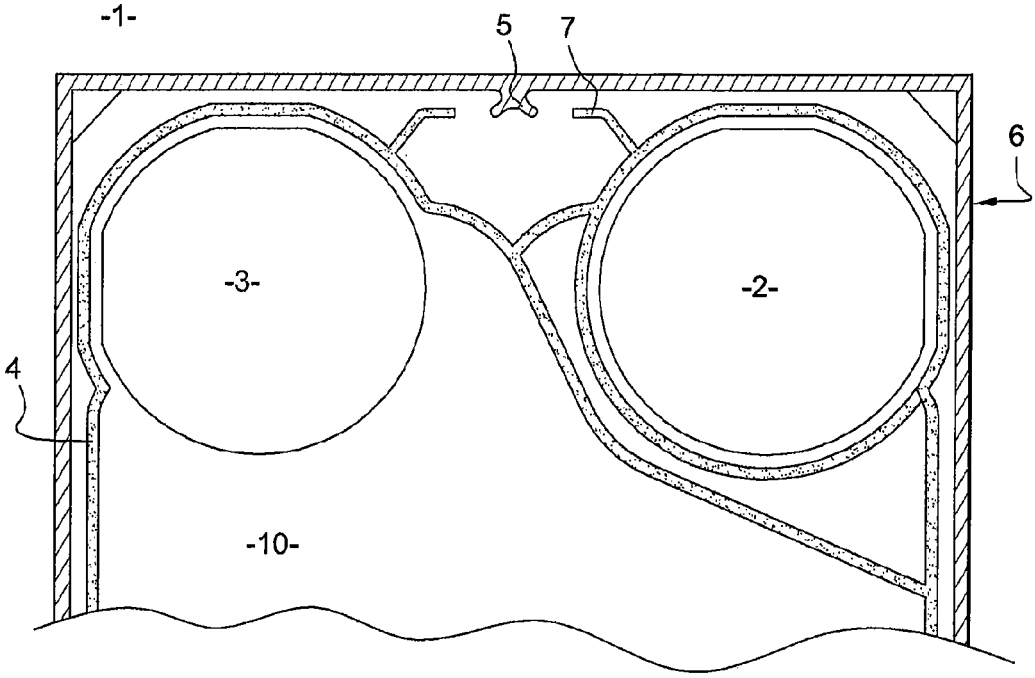
FIG. 1 is a partial cross-section view of a heat exchanger in accordance with the invention.

As already mentioned, the invention relates to a heat exchanger (1) as shown in FIG. 1. This type of exchanger with plates (10) thus includes two fluid circuits (2, 3) wherein two fluids flow in order to exchange their heat energy.

As shown, these circuits (2, 3) are defined by a seal (4) defining the periphery of the exchange area on each plate. The plates (10) are positioned inside a frame (6) and are guided in this frame via a guiding cut (5) engaging with a rail mounted on the frame (6). Struts (7) then allow each plate (10) to be positioned equidistant from one another and in parallel in proximity to this guide rail. The struts (7) are thus used to ensure the parallel positioning of the plates relative to each other before the tightening operation to compress the seal (4).

In the alternative shown, the struts (7) may form an excrescence of the seal (4). This embodiment facilitates operations to assemble and manufacture such an exchanger (1).

Figure 2:
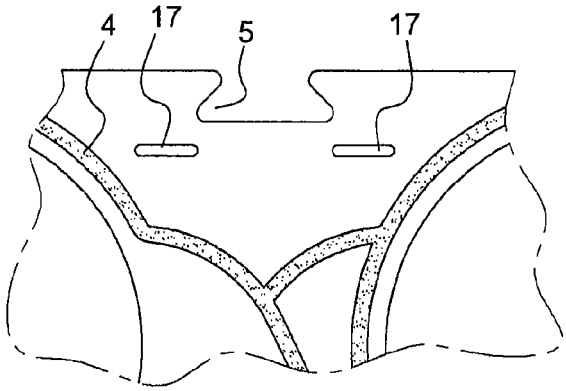
FIG. 2 is a partial front view of an exchanger plate.

As shown by the alternative in FIG. 2, the struts (17) may also be disconnected from the seal (4). It is thus possible to make heat exchangers in accordance with the invention by using a conventional already produced seal.

Figure 3:
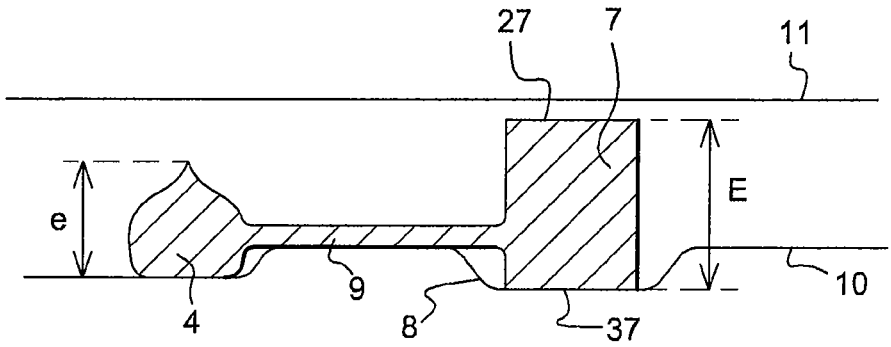
FIGS. 3 and 4 are transverse cross-section views of different forms of the strut at the interstice between two plates before they are tightened against each other.

As shown in FIG. 3, the strut (7) is in this case an excrescence of the seal (4) and is connected to it by means of a link portion (9). Furthermore, the thickness (E) of the strut (7) is greater than the thickness (e) of the seal (4). In this way, an upper face (27) of the strut (7) is first to come into contact with the upper plate (11) when the plates (10, 11) are positioned opposite one another in the frame (6). By way of example, a seal may be used with a thickness e of 6 mm combined with a strut with a thickness E of 6.2 mm.

Furthermore, a lower face (37) of the strut (7) comes to engage with a groove (8) to ensure that the strut (7) can be easily installed on and secured to the plate (10). Indeed, the strut (7) must be very accurately positioned on the plate (10) so as to engage with a plane surface on the back of the plate (11) opposite.

The upper (27) and lower (37) faces are, in the alternative shown, substantially plane so as to form a strut (7) substantially in the shape of a rectangular parallelepiped.

Figure 4:
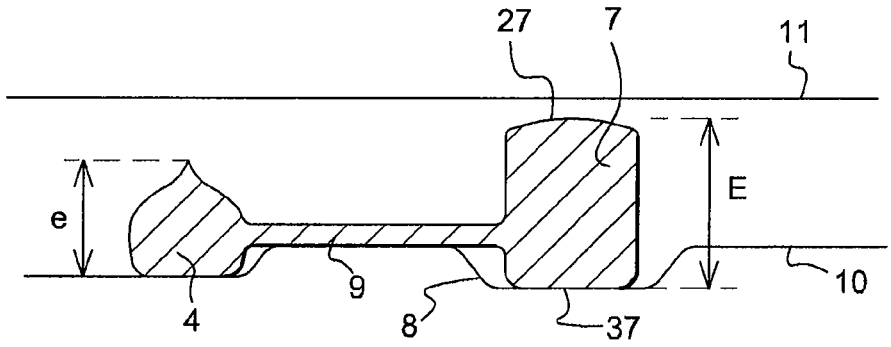

According to another alternative, and as shown in FIG. 4, the upper (27) and lower (37) faces may also form a warped concave-shaped surface before compression. In this case, when tightening, the contact between the strut (7) and the adjacent plate (11) is linear before becoming by surface area. Such a linear contact in proximity to the guide rail does however make it possible to guarantee that the plates can be positioned in parallel relative to each other.

It becomes clear from what has been said above that an exchanger with plates in accordance with the invention has manifold advantages, and in particular:

- it allows the plates to be positioned in parallel relative to each other, and perpendicular relative to the direction of thrust exerted when tightening the plates one against the other.
- it allows in particular a single guide rail to be used, thereby facilitating the installation of very large-sized plates.

The invention claimed is:

1. Heat exchanger comprising a set of plates defining circuits between the plates for a fluid flowing alternately via seals mounted between each pair of two adjacent plates, each plate including at least one guiding cut formed at least at one of ends of the plate for guiding each plate inside a frame, and further including, between each pair of two adjacent plates, and in proximity to the at least one guiding cut, at least one strut to be compressed and in contact with the two adjacent plates, each strut having, before compression, a thickness at least equal to a thickness of the seal, wherein an upper face of the at least one strut is first to come into contact with an upper plate of the two adjacent plates when the plates are positioned opposite one another in the frame, and wherein the at least one strut orients the two adjacent plates parallel to each other before the seal is acted upon by tightening of the plates.

2. Heat exchanger as claimed in claim 1, wherein each strut is inserted into a groove formed in one of the plates with which the strut comes into contact.

3. Heat exchanger as claimed in claim 1, wherein each strut is substantially in a shape of a rectangular parallelepiped.

4. Heat exchanger as claimed in claim 1, wherein each strut has greater compressibility than the seal.

5. Heat exchanger as claimed in claim 1, wherein each strut is an excrescence of the seal.

6. Heat exchanger as claimed in claim 5, further comprising a link portion between each seal and each strut, the link portion having a thickness less than the seal.

7. Heat exchanger as claimed in claim 1, wherein each strut is disconnected from the seal.

8. Heat exchanger as claimed in claim 1, wherein each strut and the seals are made out of a single material.

9. Heat exchanger as claimed in claim 1, wherein each strut and the seals are made out of two different materials.

10. Heat exchanger as claimed in claim 1, wherein each plate has only one guiding cut, a top of the seal is pointed in shape, and each strut, before compression, has a thickness greater than the thickness of the seal.

* * * * *

UNITED STATES PATENT AND TRADEMARK OFFICE

CERTIFICATE OF CORRECTION

PATENT NO. : 8,544,529 B2
APPLICATION NO. : 12/520107
DATED : October 1, 2013
INVENTOR(S) : Noel-Baron et al.

It is certified that error appears in the above-identified patent and that said Letters Patent is hereby corrected as shown below:

On the title page item (73) Delete "Viacarb" and insert --Vicarb--

Signed and Sealed this
Sixth Day of May, 2014

Michelle K. Lee

Michelle K. Lee
*Deputy Director of the United States Patent and Trademark Office*